United States Patent [19]

Morton et al.

[11] 4,375,607

[45] Mar. 1, 1983

[54] COMPACT LAMP UNIT HAVING PLUG-IN FLUORESCENT LAMP AND MODULE COMPONENTS

[75] Inventors: Edward W. Morton, Teaneck; Thomas E. Dooley, Clifton; Daniel W. O'Mullan, Bloomfield, all of N.J.

[73] Assignee: Westinghouse Electric Corp., Pittsburgh, Pa.

[21] Appl. No.: 246,502

[22] Filed: Mar. 23, 1981

[51] Int. Cl.[3] ..... H01J 7/44

[52] U.S. Cl. ..... 315/56; 315/53; 315/62

[58] Field of Search ..... 315/56, 71–75, 315/53, 62

[56] References Cited

U.S. PATENT DOCUMENTS

| | | | |
|---|---|---|---|
| 3,551,736 | 12/1970 | Doehner | 315/100 |
| 3,815,080 | 6/1974 | Summa | 339/52 R |
| 4,173,730 | 11/1979 | Young | 315/59 |
| 4,270,071 | 5/1981 | Morton | 315/53 |
| 4,311,942 | 1/1982 | Skeist et al. | 315/71 |
| 4,337,414 | 6/1982 | Young | 315/56 |

FOREIGN PATENT DOCUMENTS

| | | |
|---|---|---|
| 51-437859 | 12/1976 | Japan . |
| 2003314 | 3/1979 | United Kingdom . |

*Primary Examiner*—Harold A. Dixon
*Attorney, Agent, or Firm*—D. S. Buleza

[57] ABSTRACT

The convoluted fluorescent lamp component of a compact lamp unit is mechanically and electrically coupled to a base module by a plate-like mounting member which is secured to the module in suspended fashion and has socket means which permit the lamp component and associated energizing-circuit components to be plugged into and removed from the module. The mounting member is structured and oriented to also provide a peripheral air passageway which, in conjunction with vent openings in the module and in a protective cover which is secured to the module, allows air to flow freely through the operating unit and convection-cool the fluorescent lamp. The lamp unit can accordingly be operated at high power loadings without overheating and can also be easily relamped and provided with new circuit components (such as a ballast and/or a starter) to prolong its useful life.

17 Claims, 15 Drawing Figures

COMPACT LAMP UNIT HAVING PLUG-IN FLUORESCENT LAMP AND MODULE COMPONENTS

CROSS-REFERENCE TO RELATED APPLICATIONS

This application discloses and claims structural features for a compact lighting unit which constitute improvements over related subject matter disclosed and claimed in the following pending applications, each of which are assigned to the assignee of the present application:

U.S. Pat. No. 4,300,073 of Henry Skwirut et al. filed Feb. 13, 1979 and entitled "SCREW-IN TYPE LIGHTING UNIT HAVING A CONVOLUTED TRIDIMENSIONAL FLUORESCENT LAMP", U.S. Pat. No. 4,270,071 Edward W. Morton filed Nov. 26, 1979 and entitled "COMPOSITE BASE AND BALLAST MEMBER FOR COMPACT SINGLE-ENDED FLUORESCENT LAMP", and (U.S. Pat. No. 4,337,414) of Robert G. Young filed Nov. 26, 1979 entitled "COMPACT FLUORESCENT LAMP HAVING CONVOLUTED TUBULAR ENVELOPE OF TRIDIMENSIONAL CONFIGURATION, METHOD OF MAKING SUCH ENVELOPE AND LIGHTING UNIT INCORPORATING SUCH LAMP" now U.S. Pat. No. 4,337,414).

BACKGROUND OF THE INVENTION

This invention relates to electric lamps and has particular reference to an improved lamp unit of compact size that employs a convoluted fluorescent lamp as the light source and is adapted for use in residential and commercial lighting fixtures which are designed for incandescent-type lamps.

Fluorescent lamp units that are specially constructed for use in conventional lighting fixtures having screw-type sockets are well known in the art. A lamp unit of this type having a cylindrical envelope that contains concentric annular partitions (or which is made from tubing that is bent upon itself to provide a U-shaped bulb or one which is twisted into spiral shape) is disclosed in U.S. Pat. No. 3,551,736 to Doehner. The fluorescent lamp component has prong contacts which permit it to be plugged into a ballast unit which, in turn, is designed to be coupled to a screw-type base member that contains the starter and condenser components of the lamp-energizing circuit.

A lamp assembly having plug-in adapter means which accommodates a conventional straight tubular fluorescent lamp and couples the lamp to a threaded base component that contains a ballast transformer and thus permits the lamp assembly to be screwed into an incandescent lamp socket is disclosed in U.S. Pat. No. 3,815,080 to Summa.

In pending United Kingdom Application No. GB 2,003,314A (published Mar. 9, 1979) of Moerkens et al. there is disclosed a lamp unit comprising a U-shaped fluorescent lamp that is enclosed by a tubular glass envelope and mounted together therewith on a housing which contains the ballast and starter components of the lamp-operating circuit and is terminated by a screw-type base that will fit into a socket designed for incandescent lamps. Fluorescent luminaires that consist of a triple-U-bent fluorescent lamp that is mounted on a module that contains circuit components (such as a ballast) and is terminated by blade-like contacts or a screw-in base member are disclosed in Japanese Design Patent No. 437,859 to Takeda et al. (registered Sept. 20, 1976 and Dec. 20, 1977 on Design Applications Showa 49-28293 and Showa 49-28295).

The aforementioned pending application Ser. No. 011,832 of Skwirut et al. discloses a compact lamp unit which contains a triple-U-bent fluorescent lamp component that is supported within a vented protective cover by a module which is also vented and contains a lamp-supporting member and various lamp-circuit components and is terminated by a screw-in type base. The FIG. 8 embodiment of this application discloses a plug-in type fluorescent lamp and module combination.

The aforementioned pending Young application Ser. No. 097,279 discloses a similar lamp unit that contains a larger multi-U-bent fluorescent lamp which has a higher light output and is mounted within a vented protective cover by a base module that is also provided with vent openings and is constructed to support the lamp component and accommodate various circuit components.

The aforementioned pending Morton application Ser. No. 097,278 discloses a vented single-ended fluorescent lamp unit which contains a multi-U-bent lamp component that is mounted on a base component of such construction that it not only supports the lamp component but encloses and physically separates the ballast and capacitor components of the operating circuit.

While the prior art lamp assemblies were satisfactory from the standpoint of providing a compact fluorescent lamp unit that can be used in incandescent-type lamp sockets and fixtures, the construction of the base module in some units was such that only the lamp component could be removed from the unit and replaced. In addition, the lamp-supporting portion of the module was so designed that it restricted the free flow of air through the unit to some degree, even in those cases where the support member was apertured.

The present invention corrects both of these deficiencies by providing a compact lamp unit which contains a convoluted fluorescent lamp that is supported within a vented protective housing by a vented module which includes a base member and has a plate-like mounting member that not only supports the lamp component and various circuit components in such a manner that they can all be readily replaced, but is so constructed that it enhances rather than restricts the flow of cool air through the vented module and protective housing members of the unit. In accordance with a preferred embodiment, these very desirable functional and marketing advantages are achieved by securing a separately-formed plate-like mounting member in transverse position within the module and providing it with various connector and/or socket components and features that it mechanically and electrically couples the fluorescent lamp and expendable circuit components to the module in plug-in like fashion. In addition, the plate-like mounting member is of such size and so oriented that its periphery is spaced inwardly from the surrounding portion of the module and thus provides a peripherally-extending passageway which insures that air will flow freely through the lamp unit via the vent openings in the module and cover components.

BRIEF DESCRIPTION OF THE DRAWINGS

A better understanding of the invention will be obtained from the exemplary embodiments shown in the accompanying drawings, wherein.

DESCRIPTION OF THE PREFERRED EMBODIMENTS

While the present invention can be advantageously employed in various kinds of lamp assemblies that are suited by virtue of their small physical size and high brightness for home and office illumination, it is particularly adapted for use in conjunction with screw-in type lamp units that employ low-pressure type discharge lamps (such as fluorescent lamps) as the light source and it has, accordingly, been so illustrated and will be so described.

Figure 2:
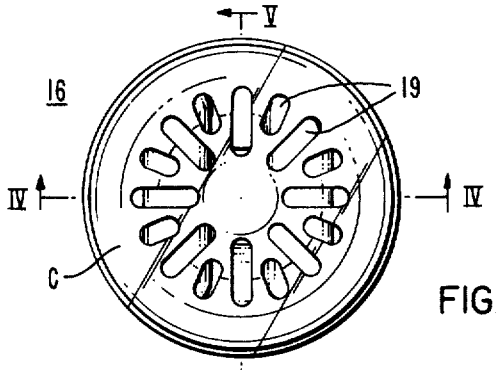
FIGS. 2 and 3 are top and bottom plan views, respectively, of the lamp unit shown in FIG. 1.
Figure 1:
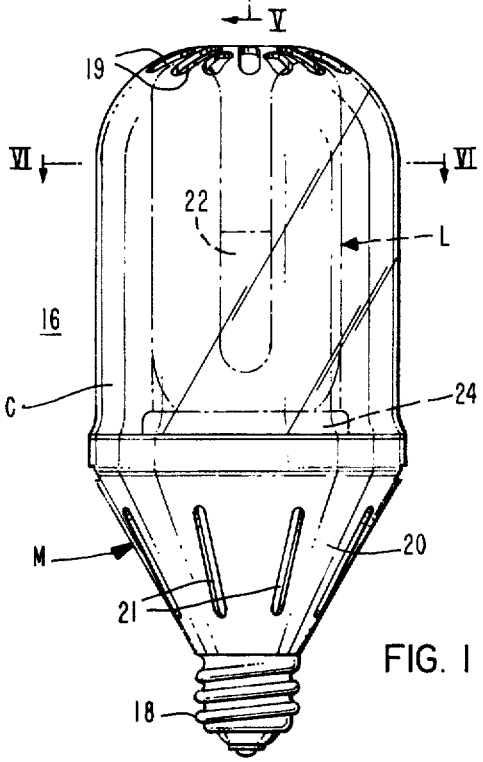
FIG. 1 is a side elevational view of a compact fluorescent lamp unit that embodies the invention.
Figure 3:
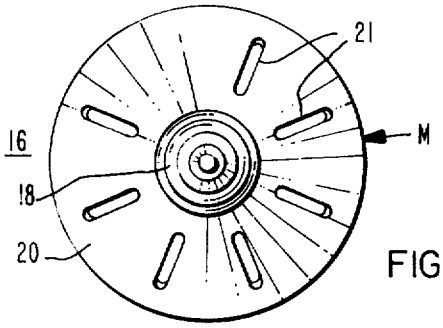

A compact lamp unit 16 embodying the invention is shown in FIG. 1 and consists of three basic components—namely, (1) a low-pressure discharge lamp such as a fluorescent lamp L having a convoluted light-transmitting envelope formed of tubular vitreous material, (2) a light-transmitting housing such as a cover C that protectively encloses the lamp component, and (3) a module M that is coupled to the cover and lamp components and is terminated by a suitable base-connector 18 that is adapted to fit and engage the socket of the lighting fixture in which the lamp unit will be used. The convoluted fluorescent lamp L is of triple-U-bent construction and the cover C is of cylindrical shape with a domed end that is provided with a series of slot openings 19 (shown more clearly in FIG. 2) which permit hot air to be vented to the atmosphere during operation of the lamp unit 16. The body portion 20 of the module M is tapered and cone-shaped in accordance with this particular embodiment and is also provided with a series of vent openings or apertures 21 so that a stream of cool air can flow through the unit. The base-connector 18 extends from the constricted end of the module M and can be of the screw-in type illustrated or of the bayonet type, depending upon the socket design of the lighting fixture or apparatus in which the lamp unit 16 will be used. As shown in FIG. 3, the vent openings 21 are arranged at spaced intervals around the conical wall 20 of the module M to provide optimum air-cooling of the lamp unit.

A ballast component 22 is also located within the lamp unit 16 and connected to the fluorescent lamp L in the manner hereinafter described.

Figure 4:
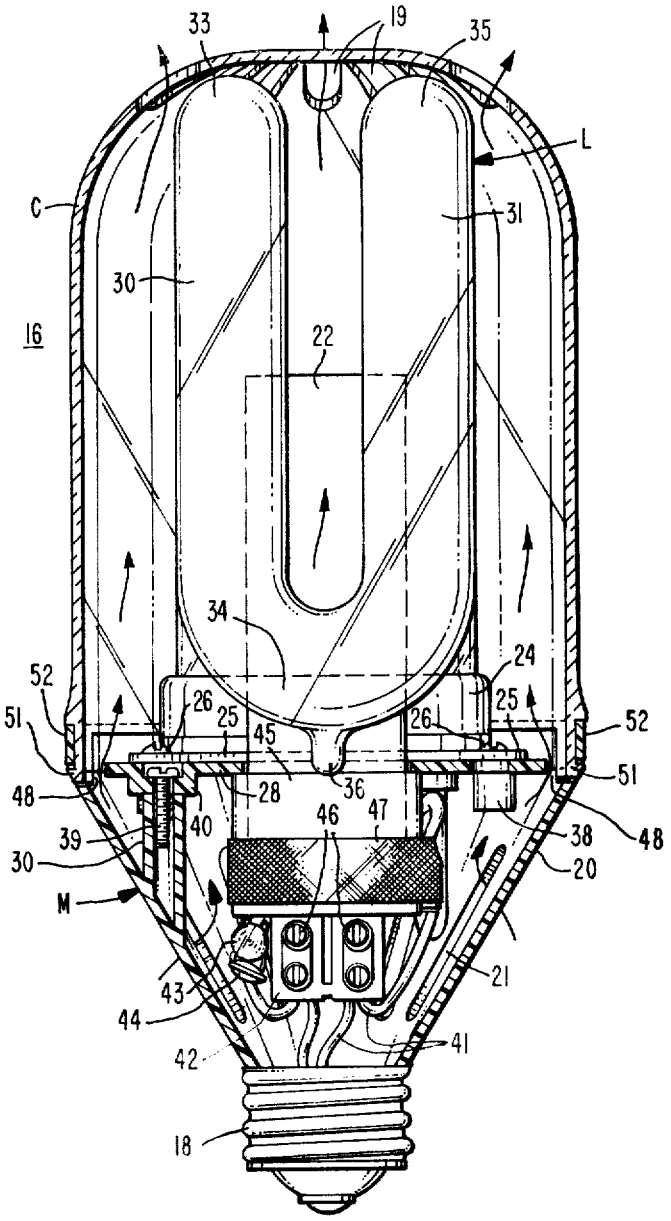
FIG. 4 is a longitudinal sectional view, on an enlarged scale, of the lamp unit along line IV—IV of FIG. 2.
Figure 5:
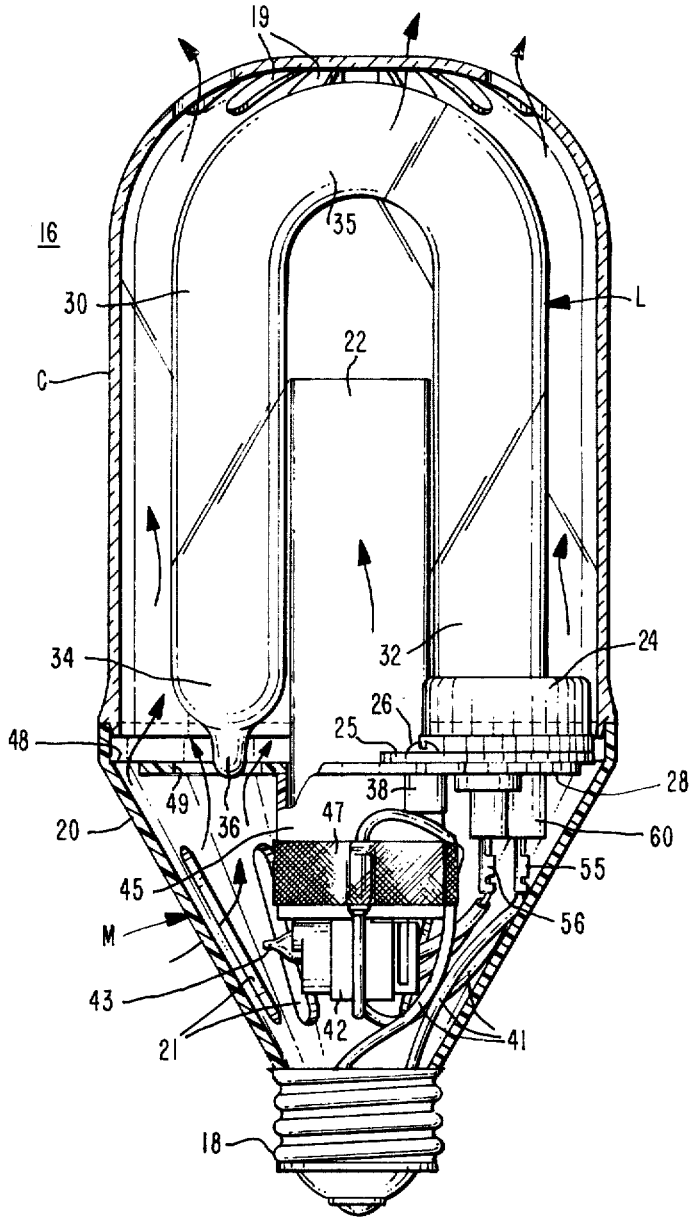
FIG. 5 is a similar view through the lamp unit along line V—V of FIG. 2.

As shown in FIGS. 4 and 5, the convoluted fluorescent lamp L is held in upstanding position within the cover C by a base member 24 that is secured to the sealed tubular ends of the envelope. The base member is fastened to a plate-like member 28 which extends transversely across the module M and is fastened to upstanding bosses 30 which protrude from the inner surface of the module body 20. Member 28 serves as a mounting component for the lamp L and various parts of the electrical circuit as explained hereafter.

Figure 9:
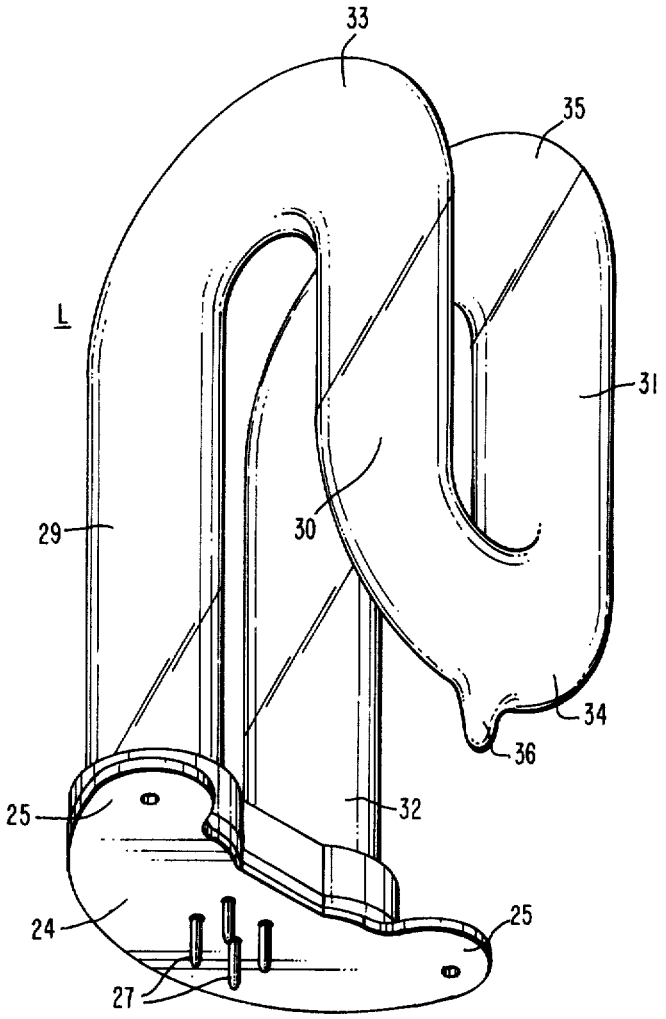
FIG. 9 is a perspective view on an enlarged scale of the plug-in fluorescent lamp component employed in the lamp unit shown in FIG. 1.

As shown more clearly in FIG. 9, the fluorescent lamp L has a convoluted envelope that is formed from conventional glass tubing which has been bent to form three conjoined U-shaped segments which are so arranged that the sealed ends of the envelope are located adjacent one another. The lamp envelope accordingly consists of four straight tubular segments 29, 30, 31 and 32 that are joined by three U-bent segments 33, 34 and 35. U-bent segment 34 is desirably provided with a tubular-shaped nipple or tip 36 which provides a cool region within the lamp during operation that helps to control the mercury-vapor pressure. The ends of envelope segments 29, 32 are joined by base member 24 which is cemented or otherwise secured to the envelope in enclosing relationship with its sealed ends. In accordance with this embodiment the base member 24 is provided with a pair of apertured tabular portions 25 which extend laterally and can be secured with suitable fasteners to the plate-like mounting member 28 of the module M. Suitable contactor elements, such as metal pins 27, protrude from the bottom of the lamp base 24 and are connected to electrodes sealed within the ends of the envelope, thus permitting the convoluted fluorescent lamp L to be plugged into and readily removed from the module M. Of course, the convoluted envelope is provided with an inner coating of a suitable phosphor material and contains an ionizable medium such as a predetermined dose of mercury and a starting gas in accordance with standard lamp-making practice.

Returning to FIGS. 4 and 5, it will be noted that the tabular portions 25 of base member 24 are secured to the mounting plate 28 with screw fasteners 26 so that the convoluted fluorescent lamp L is firmly seated on the plate and locked in upstanding position within the protective cover C. The plate 28, in turn, is securely fastened to the module M by another set of screw fasteners 39 (see FIG. 4) that extend through suitable reinforced apertured portions 40 of the mounting plate and engage the respective bosses 30 that protrude from the inner wall of the module M. The base pins 27 of the fluorescent lamp L engage electrical-receptacle elements 55, 56 (FIG. 5) carried by the mounting plate 28 (as hereinafter explained and shown in FIG. 8) which elements, in turn, are connected by insulated conductors 41 and a junction block 42 to the ballast component 22 and the usual starter means consisting of a glow switch 43 and condenser 44 which start the lamp L in pre-heat fashion.

As will be noted, the central part 45 of the mounting plate 28 extends into the module M and defines a box-like pocket or cavity that accommodates the lower end of the elongated ballast component 22 so that the ballast is held in stabilized upstanding position in the central opening or space defined by U-bent segments of the convoluted lamp L. The ballast component 22 is accordingly securely locked in telescoped and nested relationship with the U-bent segments of the fluorescent lamp L by the plate 28. As illustrated, the junction block 42 is seated against the bottom of the box-like portion 45 of the plate 28 and includes a number of screw fasteners 46 that lock the inserted ends of the various wire conductors 41 in engagement with pin contacts that protrude from the bottom of the ballast component 22 into the junction block. The electrical circuit elements (with the exception of the upper part of the inductive ballast 22) and various connections are accordingly located within the chamber that is defined by the body portion 20 of the module M and the mounting plate 28 that extends across the top of the module. The various conductors 41 are desirably held in place by suitable means such as a strip of adhesive tape 47 that is wrapped around the box-like portion 45 of the plate 28.

An important feature of the present invention resides in the fact that the plate-like mount component 28 not only serves as an "interface" means that mechanically and electrically couples the convoluted lamp L and associated circuit components to each other and the module M, but that it does so in a manner such that it does not obstruct but actually enhances the free passage of air through the lamp unit 16 when the latter is operated in either a base-up or base-down burning position. This is achieved by making the mounting plate 28 smaller than the surrounding portion of the module M and positioning the plate so that its peripheral edges are spaced inwardly from the body 20 of the module and rim of the cover C, as shown most clearly in FIG. 6. The resulting space or gap between the peripheral edge of the plate 28 and the surrounding portions of the module M and cover C serves as a passageway 48 that extends around the entire circumference of the plate and is partially blocked by the arcuate outer rim of the lamp base 24. As indicated by the arrows in FIGS. 4, 5 and 6, when the lamp unit 16 is burned in a base-down position a "curtain-like" stream of cool air flows freely from the vented module M through the peripheral passageway 48 and upwardly through the protective cover C around the convoluted lamp L along the cover-lamp interspace and out through the vent openings 19 in the top of the cover. Of course, when the lamp unit 16 is operated in a base-up position, the flow of air would be in the opposite direction. The air flow thus convection-cools the fluorescent lamp L and prevents it from operating at an excessive temperature—thereby avoiding the drop in light output due to the rise in the pressure of the mercury vapor within the lamp envelope which would otherwise occur.

Of course, air cooling of the lamp unit 16 would be even further improved if the lamp base 24 were contoured so that its arcuate outer edge was flush with the periphery of the underlying mounting plate 28 and thus permitted air to flow through the peripheral passageway 48 around the entire circumference of the plate. This slight modification should be made if maximum air-cooling of the unit is required or desired.

As shown in FIG. 5, the mounting plate 28 is preferably provided with an opening 49 that accommodates and is much larger than the tip segment 36 of the lamp L so that air also flows around and cools the tip segment (as indicated by the arrows).

Figure 6:
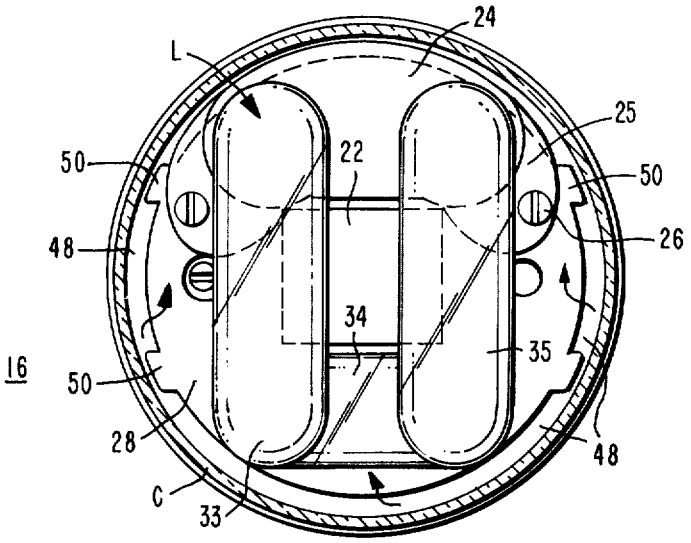
FIG. 6 is an enlarged cross-sectional view of the lamp unit along line VI—VI of FIG. 1.
Figure 7:
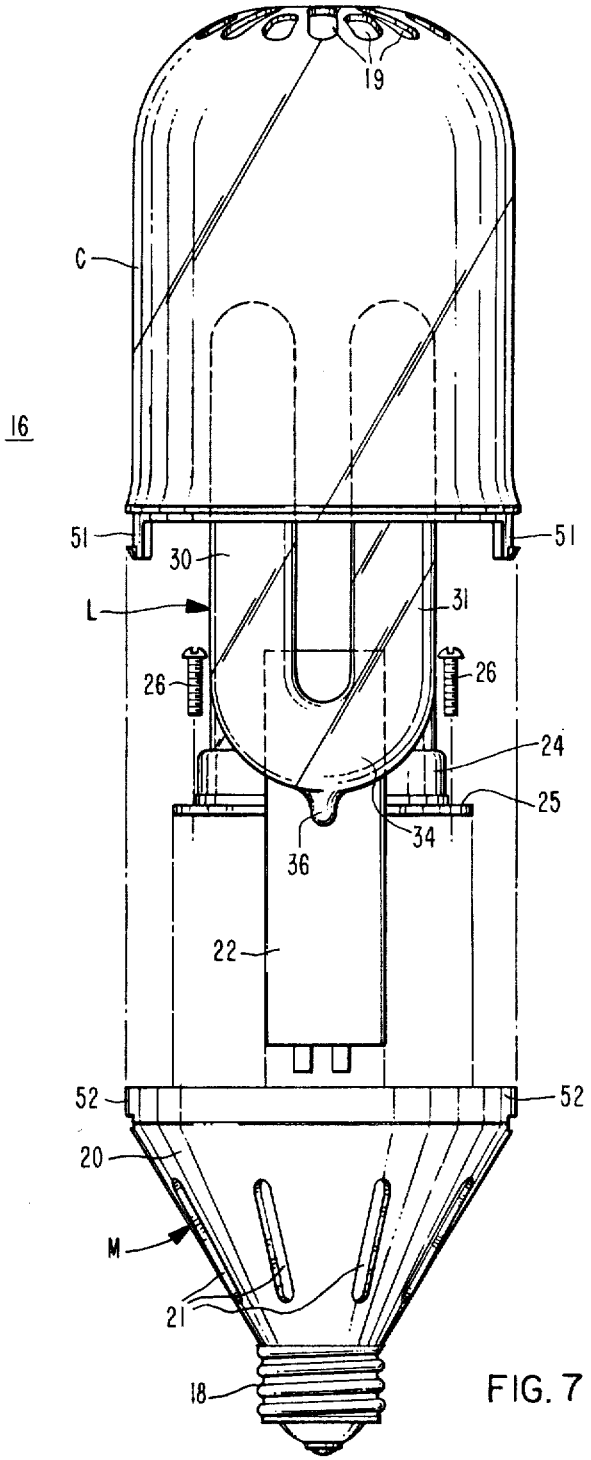
FIG. 7 is an exploded elevational view of the various components which comprise the lamp unit of FIG. 1.

As will be noted in FIG. 6, several circumferentially spaced tabs 50 protrude from the rim of the plate 28. These tabs serve as stops for a pair of tongue-like elements 51 that effect a slip-lock juncture with slotted rim portions 52 of the module M (shown in FIG. 4). The protective cover C is thus releasably fastened to the module M and can be detached and removed from the unit 16 along with the fluorescent lamp L and the ballast component 22. These very advantageous features are shown in greater detail in FIG. 7. As illustrated, the cover component C, convoluted fluorescent lamp L and ballast component 22 are all releasably secured to the module subassembly in telescoped interfitting relationship by the mounting plate and various connector means described previously to provide the desired compactness and easy replacement of the lamp and ballast components.

Figure 8:
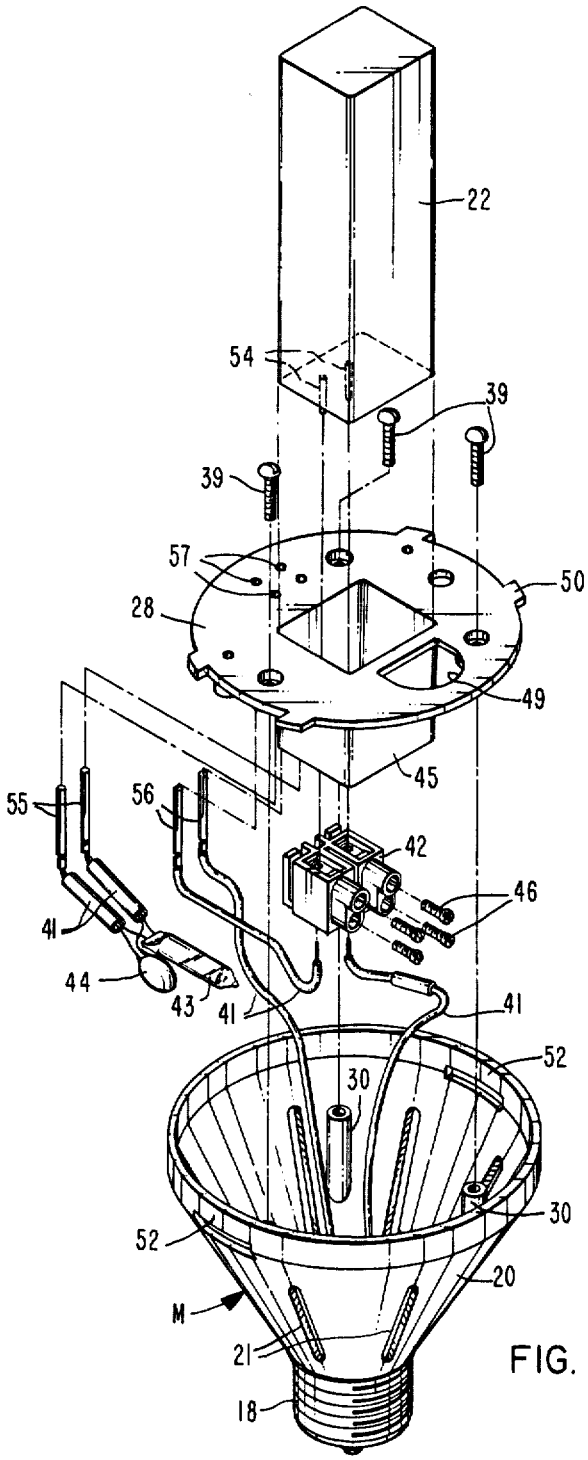
FIG. 8 is an exploded perspective view of the module subassembly employed in the lamp unit of FIG. 1 illustrating the manner in which the various components are coupled to each other and the circuit components.

The manner in which the plate-like mounting member 28 is coupled to the module M, the inductive ballast component 22 and other circuit elements to form an integral subassembly is shown in FIG. 8. As will be noted, the various insulated conductors 41 connect the terminals of the screw-type base connector 18 to pin contacts 54 on the bottom of the ballast component 22 by means of the junction block 42 and its screw fasteners 46, which are tightened after the ballast component has been inserted into the box-like portion 45 of the plate 28. The conductors 41 also connect the glow switch 43 and capacitor 44 in parallel relationship to a pair of plug-in receptacles 55 which, together with a second pair of such receptacles 56 that are connected to the base-connector 18 and junction block 42, are force-fitted into suitable apertures 57 in the mounting plate 28 and thus form a plug-in socket for the pin terminals 27 of the fluorescent lamp L. The plate 28 is locked in suspended transverse position within the module M (in planar relationship with its slotted rim portions 52) by screws 39 that fit into suitable spaced openings in the plate and engage the three upwardly-extending bosses 30 formed on the inner wall of the module body 20. The plate 28 also includes the opening 49 which accommodates the depending tip segment 36 of the lamp envelope and also serves as convection-cooling means for this critical portion of the convoluted fluorescent lamp L, as previously described.

Figure 10:
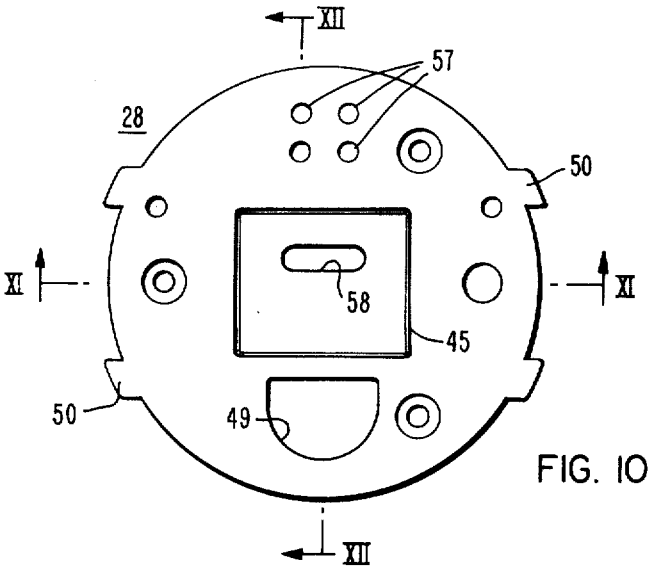
FIG. 10 is a plan view, on an enlarged scale, of the plate-like mounting member employed in the FIG. 1 embodiment.
Figure 11:
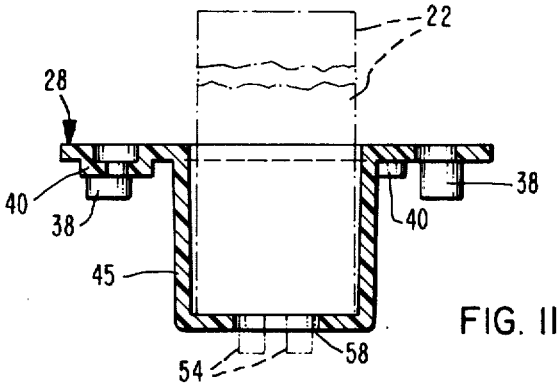
FIGS. 11 and 12 are cross-sectional views through the mounting member along lines XI—XI and XII—XII, respectively, of FIG. 10.
Figure 12:
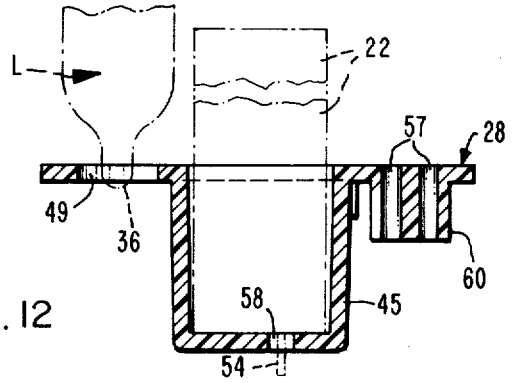

A more detailed illustration of the plate-like mounting member 28 is shown in FIGS. 10–12. As illustrated, the plate is preferably formed in one piece from suitable insulating material such as a plastic and has the aforementioned apertures 57 and opening 49 for accommodating the plug-in electrical receptacles 55, 56 and the tubular tip 36 of the envelope. The box-like portion 45 of the plate is also provided with a slot 58 for the pins 54 of the ballast component 22 when the latter is inserted into the harness plate. The portions of the plate 28 around the openings for the various screw fasteners 26, 39 and plug-in connectors 55, 56 are reinforced by bosses 38, 40 and 60 to permit the mounting plate to bear the physical load of the various mounted components without breaking. The ballast component 22 and cooling tip portion 36 of the lamp L are shown in phantom in FIGS. 11 and 12 to show how these parts fit into the plate 28.

Figure 13:
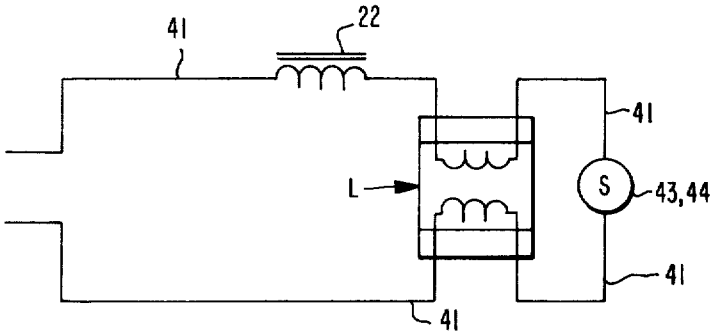
FIG. 13 is a schematic of the lamp operating circuit which comprises an integral part of the compact lamp unit of FIG. 1.

FIG. 13 is a schematic of the various circuit elements and the manner in which they are connected with the convoluted fluorescent lamp L to start and operate it when the lamp unit 16 is coupled to an alternating-current power supply. As shown, the starter component S (consisting of the glow switch 43 and noise-suppressing condenser 44) is connected in series with the lamp electrodes by the conductors 41 so that the lamp L starts in the conventional pre-heat fashion. Conductors 41 also connect the inductive ballast component 22 in series with the lamp electrodes and starter S in the usual manner to control the lamp current during operation.

Figure 14:
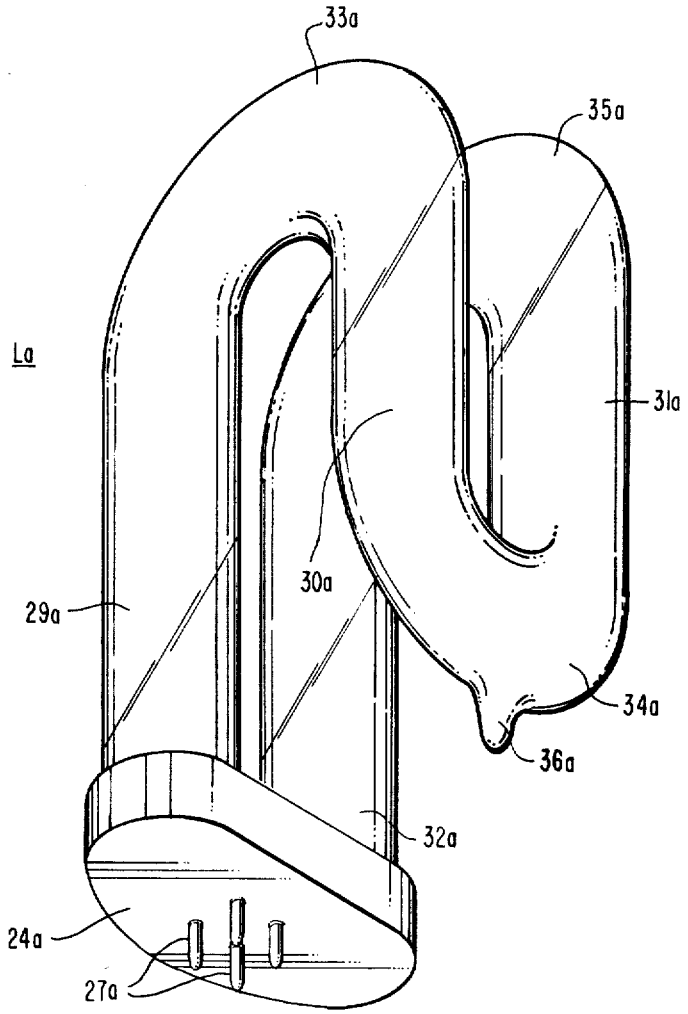
FIG. 14 is an enlarged perspective view of another form of plug-in fluorescent lamp component which can be employed in the improved lamp unit of the invention.

An alternative form of convoluted fluorescent lamp La which can be more easily plugged into and out of the mount plate portion 28 of the module M is shown in FIG. 14. The lamp envelope is of the same triple-U-bent shape as in the previous embodiment but has its terminating leg portions 29*a* and 32*a* secured to a base member 24*a* that does not have tabular extensions and thus does not require any fasteners or screws to anchor the lamp to the harness plate. To ensure that the base pins 27*a* will be securely locked in electrical engagement with the electrical-receptacle members 55, 56 carried by the member plate 28, the plate member can be formed in such a manner that it has a shallow recess which will nestingly receive the base member 24*a* and thus provide a snug interfitting and force fit of the components. If desired or required, snap-fitting elements can also be provided on the sides of the base 24*a* and/or in the base-receiving portion of the mounting plate to provide a more positive interlocking action.

Figure 15:
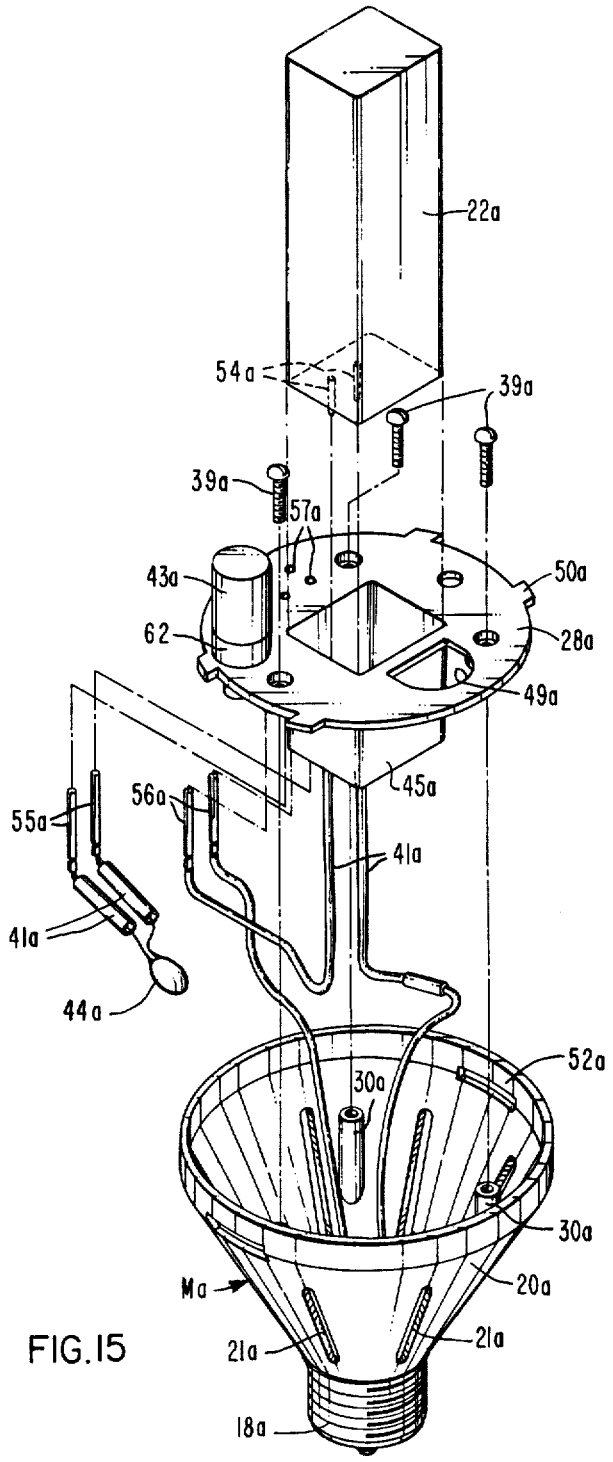
FIG. 15 is an exploded perspective view of an alternate form of module subassembly which has a mounting plate that permits the ballast and starter components to be made in the form of plug-in components along with the convoluted fluorescent lamp.

An alternate form of module-plate subassembly which permits the glow switch component to be plugged into and removed from the mounting plate along with the ballast component and convoluted fluorescent lamp is shown in FIG. 15. As will be noted, this advantageous structural arrangement is achieved by separating the glow switch from the condenser 44*a* and placing it within a small cylindrical container to form a component 43*a* that plugs into a suitable receptacle or socket 62 that is mounted on top of the plate member 28*a*. Suitable conductors (not shown) on the bottom face of the plate connect the glow-switch component 43*a* with the plug-in receptacles 55*a*, 56*a* when the latter are inserted into the plate apertures 57*a* so that the glow switch and condenser are connected in the same parallel relationship as before. In accordance with this embodiment, the junction block within the module Ma is also eliminated and replaced by receptacle means (not shown) that comprises an integral part of the box-like portion 45*a* of the mounting plate 28*a* and functions as a plug-in socket for the pins 54*a* of the ballast component 22*a*. The other structural features and coupling arrangements of the alternative module-plate subassembly depicted in FIG. 15 are identical to those previously described in connection with the other embodiment.

The protective cover C is preferably made from a suitable high-temperature plastic that is clear or translucent. The lamp base members 24, 24*a* and the body portions 20, 20*a* of the modules M and Ma can also be fabricated from suitable plastic that has the proper strength and temperature-resistant characteristics.

We claim as our invention:

1. An electric lamp unit adapted for use in lighting apparatus that requires a light source of compact size and includes socket means, said lamp unit comprising;

a low-pressure electric discharge lamp having a convoluted envelope that is formed from tubular light-transmitting vitreous material and contains an ionizable medium and a pair of electrodes, said convoluted envelope defining a tortuous discharge channel of such configuration that the ends of the envelope are disposed proximate one another, said discharge lamp having a base member that joins the ends of the convoluted envelope and includes protruding contact elements that are connected to the respective electrodes, a protective housing of light-transmitting material enclosing said convoluted discharge lamp, a module releasably secured to said protective housing and terminated by a base-connector component that is adapted to releasably engage the socket means of said lighting apparatus, electrical-conductor means within said module connected to said base-connector component, and means electrically and mechanically coupling the module to the convoluted discharge lamp comprising a plate-like mounting member that (a) is fastened to interior portions of the module and is held thereby in suspended transversely-extending position within the module remote from the base-connector component so that said mounting member and module define a chamber and constitute an integral subassembly, (b) includes electrical-receptacle means that are disposed in slip-fitted plug-in engagement with the protruding contact elements of the convoluted discharge lamp and connect the discharge lamp to the electrical-conductor means located within the module, and (c) has anchoring means which releasably engages the based end of the discharge lamp and holds the lamp in interfitted upstanding relationship with the mounting member so that the discharge lamp and protective housing can both be detached and separated from the module.

2. The electric lamp unit of claim 1 wherein;

said convoluted discharge lamp comprises a fluorescent lamp, and a glow-switch component is also mounted on the plate-like mounting member and is releasably held in such position by socket means that comprises an integral part of the mounting member and connects the glow-switch component in pre-heat starting relationship with the fluorescent lamp through the electrical-conductor means located within the module.

3. The electric lamp unit of claim 1 wherein;

said convoluted discharge lamp comprises a fluorescent lamp, and a ballast component is also mounted on the plate-like mounting member and is releasably held in such relationship by juncture means that is carried by the mounting member and connects the ballast component to the fluorescent lamp through the electrical-conductor means located within the module.

4. The electric lamp unit of claim 3 wherein;

said convoluted fluorescent lamp has an envelope of such configuration that an unobstructed region extends upwardly into the convoluted lamp envelope from the plate-like mounting member, and the ballast component is of elongated configuration and so oriented that it is disposed in the unobstructed region within the convoluted fluorescent lamp.

5. The electric lamp unit of claim 4 wherein;

a medial portion of the plate-like mounting member is contoured to define a cavity that extends toward the base-connector end of the module, and a portion of the elongated ballast component is nestingly disposed within said cavity and is thus in telescoped interfitted relationship with the mounting member.

6. The electric lamp unit of claim 3 wherein a glow-switch starter component is also mounted on the plate-like mounting member and is releasably held in such position by socket means that comprises an integral part of the mounting member and connects the glow-switch component to the convoluted fluorescent lamp through the electrical-conductor means located within the module so that said fluorescent lamp, protective housing, ballast component and glow-switch starter component are all adapted to be detached and separated from the module-mount subassembly.

7. The electric lamp unit of claim 1 wherein;

said module and protective housing each have at least one vent opening therein, and said plate-like mounting member is smaller than and spaced from the surrounding portion of the module and thereby provides a peripherally-extending passageway which, in cooperation with the vent openings in the module and protective housing, permits air to flow freely through the operating lamp unit with resultant convection-cooling of the energized discharge lamp.

8. The electric lamp unit of claim 7 wherein the relative sizes and positions of the module and plate-like mounting member are such that the air passageway extends along a major portion of the periphery of the mounting member.

9. The electric lamp unit of claim 8 wherein the size and shape of the protective housing relative to those of the convoluted discharge lamp are such that the housing is spaced from the sides of the lamp envelope and the air which traverses the peripheral passageway flows along the envelope-housing interspace.

10. The electric lamp unit of claim 7 wherein;

said plate-like mounting member is located at the end of the module opposite the base-connector component, and the module chamber is defined by the part of the module that extends between the mounting member and base-connector component and the electrical-conductor means is located within said chamber 11. The electric lamp unit of claim 7 wherein;

said plate-like mounting member comprises a preformed plastic member, and said module has a plurality of spaced interior bosses that extend toward the convoluted discharge lamp and serve as the support means for the plastic mounting member.

12. The electric lamp unit of claim 7 wherein;

said convoluted discharge lamp comprises a fluorescent lamp that has a plurality of U-bent envelope sections, the lamp contact elements comprise metal pins that are held in predetermined position by the lamp base member, and the electrical-receptacle means in plug-in engagement with the based end of the fluorescent lamp comprises a socket that is carried by the plate-like mounting member.

13. The electric lamp unit of claim 12 wherein the lamp base member has a pair of laterally-extending tab portions that are secured to the plate-like mounting member by removable fasteners.

14. The electric lamp unit of claim 12 wherein;

the base-connector component of the module is of the screw-in type, and the body portion of the module and the plate-like mounting member are composed of plastic.

15. The electric lamp unit of claim 12 wherein;

said convoluted fluorescent lamp is of triple-U-bent construction, and an inductive ballast component of elongated configuration is mounted on said mounting member and extends upwardly therefrom into nested relationship with the three U-shaped segments of the lamp envelope.

16. The electric lamp unit of claim 15 wherein;

a U-bent portion of the lamp envelope which is adjacent the mounting member has a depending tip segment that protrudes toward the mounting member and defines a mercury-vapor pressure-regulating region within the convoluted fluorescent lamp, and the mounting member has an opening therein that accommodates the tip segment of the envelope and is of sufficient size to permit some of the air which flows through the lamp unit to pass through said opening and thus also convection-cool the tip segment of the lamp envelope.

17. The electric lamp unit of claim 16 wherein;

said lamp housing comprises a cylindrical shaped cover that has a plurality of vent openings therein which are substantially located at the top of the cover, said module is cone-shaped and also has a plurality of vent openings therein, and said ballast component is coupled to plug-in-type socket means carried by the mounting member which permits the ballast component to be readily detached and removed from the module along with the fluorescent and protective cover.

* * * * *